US005305547A

United States Patent [19]

Weiss

[11] Patent Number: 5,305,547

[45] Date of Patent: Apr. 26, 1994

[54] ELECTRICAL CONNECTOR ARRANGEMENT

[75] Inventor: Christopher J. Weiss, Cheltenham, Australia

[73] Assignee: Alcatel Components Limited, Australia

[21] Appl. No.: 974,538

[22] Filed: Nov. 12, 1992

[30] Foreign Application Priority Data

Nov. 14, 1991 [AU] Australia ..... PK-9486

[51] Int. Cl.[5] ..... H01R 4/24

[52] U.S. Cl. ..... 439/395; 439/417

[58] Field of Search ..... 439/389–425

[56] References Cited

U.S. PATENT DOCUMENTS 4,193,201 3/1980 Van Horn ..... 439/395

4,969,839 11/1990 Nilsson ..... 439/395

*Primary Examiner*—Joseph H. McGlynn

[57] ABSTRACT

This invention relates to two-part electrical coupling connectors for use with audio cables, and in particular to a means by which insulated conductors of the cable are connected to contact elements of the coupling connector.

21 Claims, 5 Drawing Sheets

ELECTRICAL CONNECTOR ARRANGEMENT

TECHNICAL FIELD

This invention relates to electrical connectors and in particular to two-part coupling connectors, particularly, though not exclusively, for disconnectably interconnecting the conductors of audio cables, or disconnectably connecting the conductors of audio cables to appliances.

BACKGROUND OF THE INVENTION

Such connectors are known and essentially comprise a pair of mating connector elements one containing at least one contact element in the form of a plug, and the other containing at least one mating contact element in the form of a socket, or a combination of both plugs and sockets, the contact elements contacting when the connector elements are mated. The contact elements are electrically connected to respective conductors of a cable by various means, such as, for example, soldering, crimping or screw terminals. The connector may be a free connector, that is each connector element is connected to the end of a cable for interconnecting the cables, or one connector element may be mounted on a chasis for coupling to the other connector element connected to a cable.

Cable harness manufacturers may supply a customer with a cable harness with connector elements already connected, in which case it is necessary for the manufacturer to introduce further steps in the assembly of the cable harness to terminate the cable conductors on the contact elements of the connector element. These further steps increase production time and require additional skills of assemblers. Further, if termination is by soldering, hazardous fumes produced during soldering introduce health and safety problems in the assembly area.

In cases where the termination of the cable conductors to the connector's contact elements is carried out in the field rather than in the factory, electric power is required. This may, in some situations, present difficulties.

SUMMARY OF THE INVENTION

It is an object of the present invention to provide a connector element arrangement to which cable conductors can be terminated in a quick and easy manner requiring no special skill.

According to the invention there is provided an electrical connector element, comprising a contact element housing and a mateable insulated-wire terminal means, said contact element housing fixedly supporting at least one forwardly extending contact element whose opposite end terminates in a rearwardly extending insulation-penetrating means, said insulated-wire terminal means including at least one slot arranged to receive said insulation-penetrating means when said contact element housing and said insulated-wire terminal means are mated, and an insulated-wire guide means arranged transverse said slot such that when an insulated-wire is laid in said guide means and said contact element housing and said insulated-wire terminal means are mated by axial force, said insulation-penetrating means cuts the insulation of said insulated-wire in the said guide means to provide electrical connection between said insulated-wire and said contact element.

BRIEF DESCRIPTION OF THE DRAWINGS

In order that the invention may be readily carried into effect, embodiments thereof will now be described in relation to the drawings, in which.

BEST MODE FOR CARRYING OUT THE INVENTION

Figure 1:
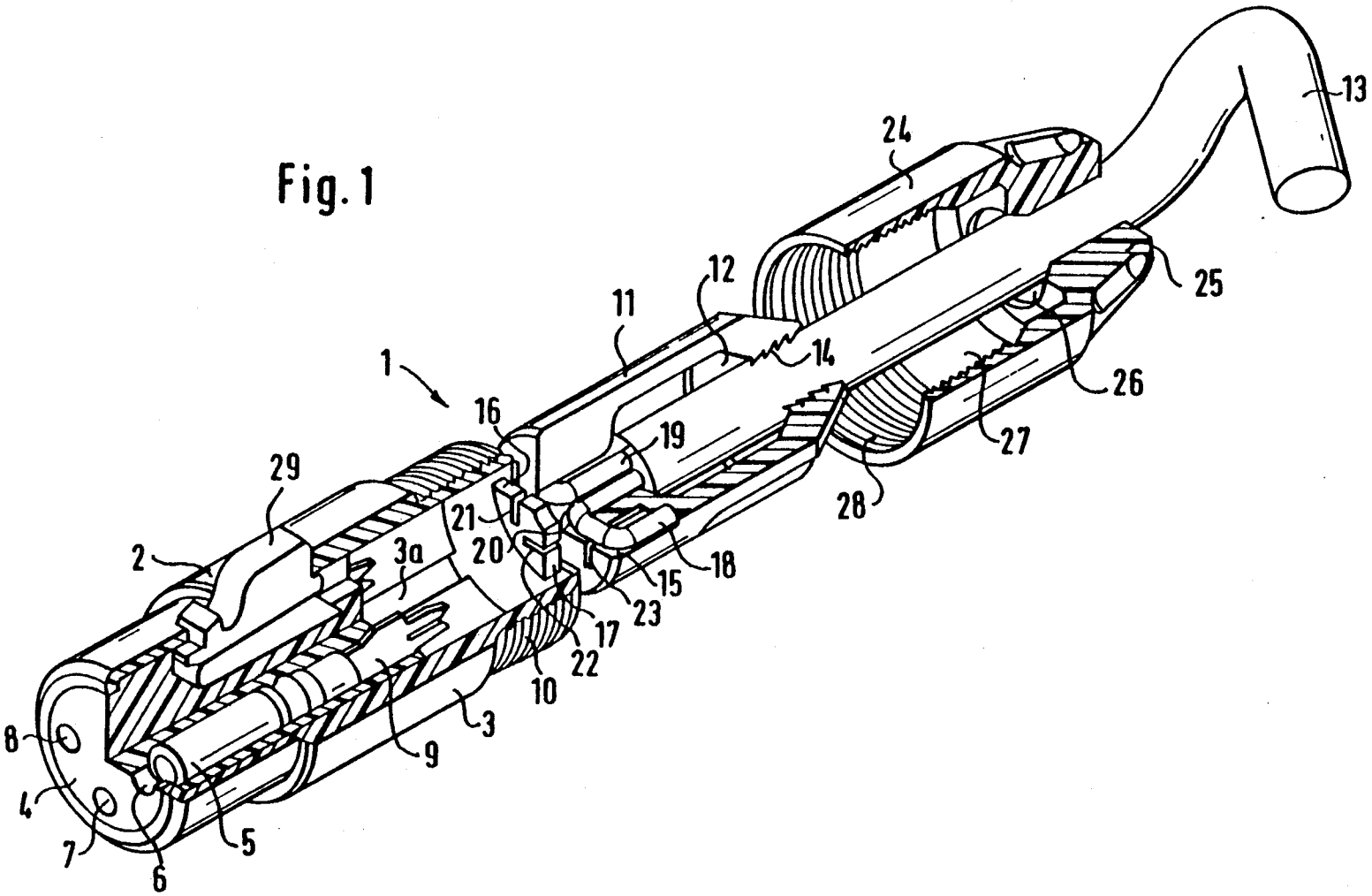
FIG.1 is a cut-away perspective view of a first embodiment of a coupling connector element incorporating the invention.

Referring to FIG. 1, the connector element 1 comprises a body 2 of circular cross section including a shell portion 3, and an insert 4, the latter being either constructed of a hard plastics material or a resilient material, such as, for example, rubber. An array of female contact elements, only one, 5, being shown, are each fixedly supported within a cylindrical cavity 6, 7 and 8 within the boundary of insert 4. The rear portion of the contact elements protrude rearwardly through insert 4 into a space defined by the rear part of shell portion 3. Attached to the rear portion of each contact element is a rearwardly extending insulation-penetrating slotted plate 9, only one of which is shown entirely. Shell portion 3 is provided with a screw threaded portion 10 on the outer surface of its rear end.

Connector element 1 further comprises a central collet 11 having a coaxial bore 12 for accommodating a cable 13, a cable clamping means 14, and wire-guide slots 15, 16 and 17 for respectively locating insulated conductors 18, 19 and 20 transverse scabbards 21, 22 and 23 each of which is located opposite a slotted plate. Collet 11 is also provided with a locating and anti-rotation key (not shown) for co-operating with an axial groove 3*a* in the inner wall of the rear part of shell portion 3.

Connector element 1 further comprises cup-shaped end portion comprising a side wall 24 and a thick rear wall 25 provided with a coaxial bore 26 for receiving cable 13. Walls 24 and 25 define an inner space 27 for slidably receiving part of collet 11. The forward end of the inner surface of side wall 24 is provided with a screw threaded portion 28.

The diameter of insert 4 is such that it slidably fits within the boundary of the inner diameter of shell portion 3.

Insert 4 also includes a releasable spring loaded latch arrangement 29 for releasably latching coupled connector elements.

Figure 2:
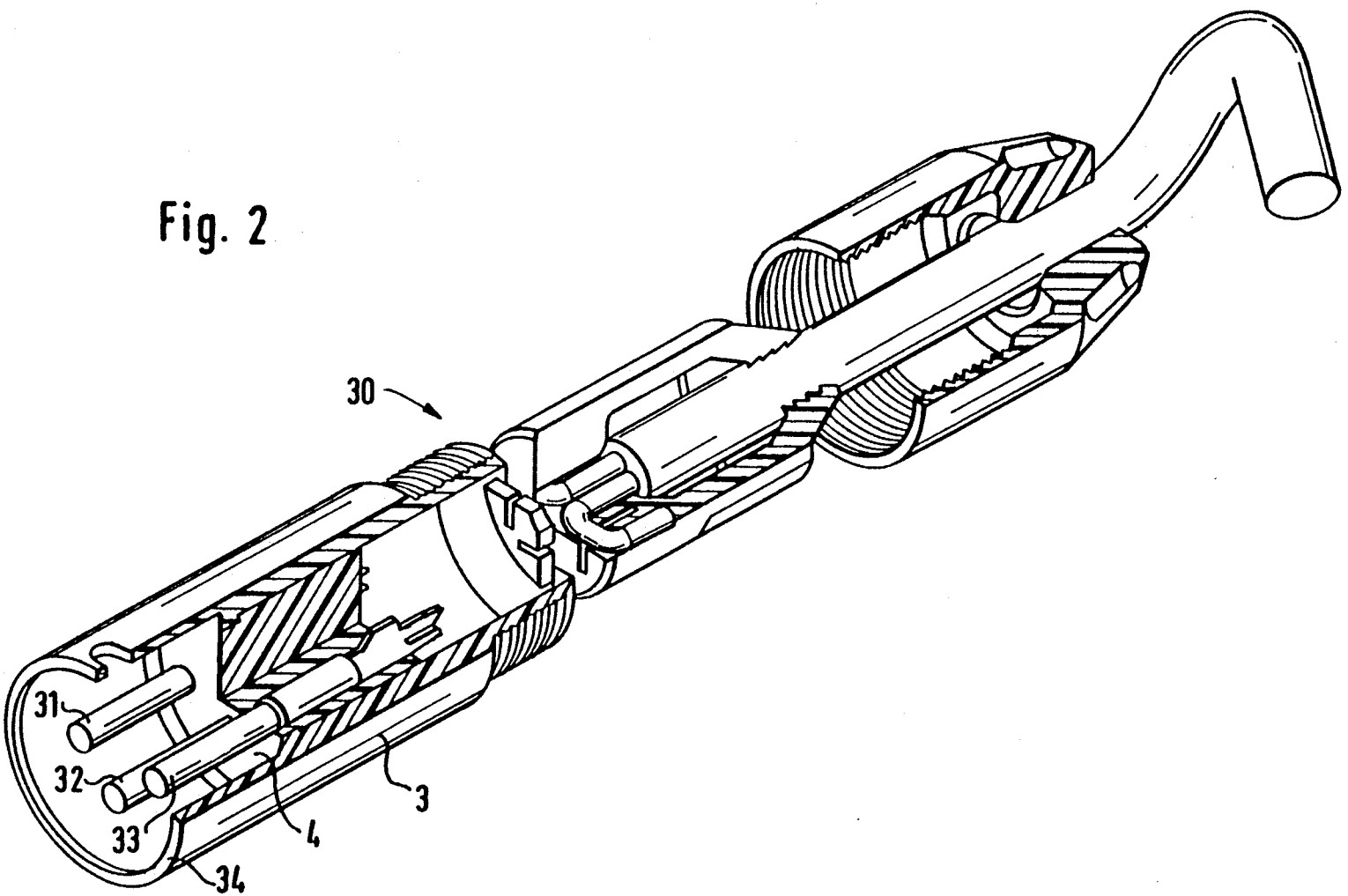
FIG. 2 is a cut-away perspective view of a coupling connector element for mating with the connector element shown in FIG. 1, incorporating the invention.

Referring to FIG. 2, the connector element 30, for mating with connector element 1 of FIG. 1, is identical to connector element 1 except that it has male contact elements 31, 32 and 33 for co-operating with the female connector elements of connector element 1. The male contact elements 31, 32 and 33 extend outwardly from cavities of the boundary of inset 4 into a space defined by a forward section 34 of shell portion 3.

In use, a predetermined length of sheath is removed from an end of cable 13 to expose lengths of insulated conductors 18, 19 and 20. The so exposed lengths are then fed through bore 26 of the cup-shaped end portion and through bore 12 of collet 11. The insulated conductors 18, 19 and 20 are then laid in respective guide-slots 15, 16 and 17. The key of the thus loaded collet is located in axial groove 3*a* and the collet is then moved axially into the rear part of shell portion 3. The cup-shaped end portion is then screwed onto threaded portion 10 of shell portion 3 which urges collet 11 towards the slotted plates 9 which eventually enter scabbards 21, 22 and 23 and cut into the insulation of respective conductors 18, 19 and 20 thereby electrically connecting the conductors to the contact elements At the same time radial pressure is exerted by the cup-shaped end portion on the cable clamping means 14.

Figure 3:
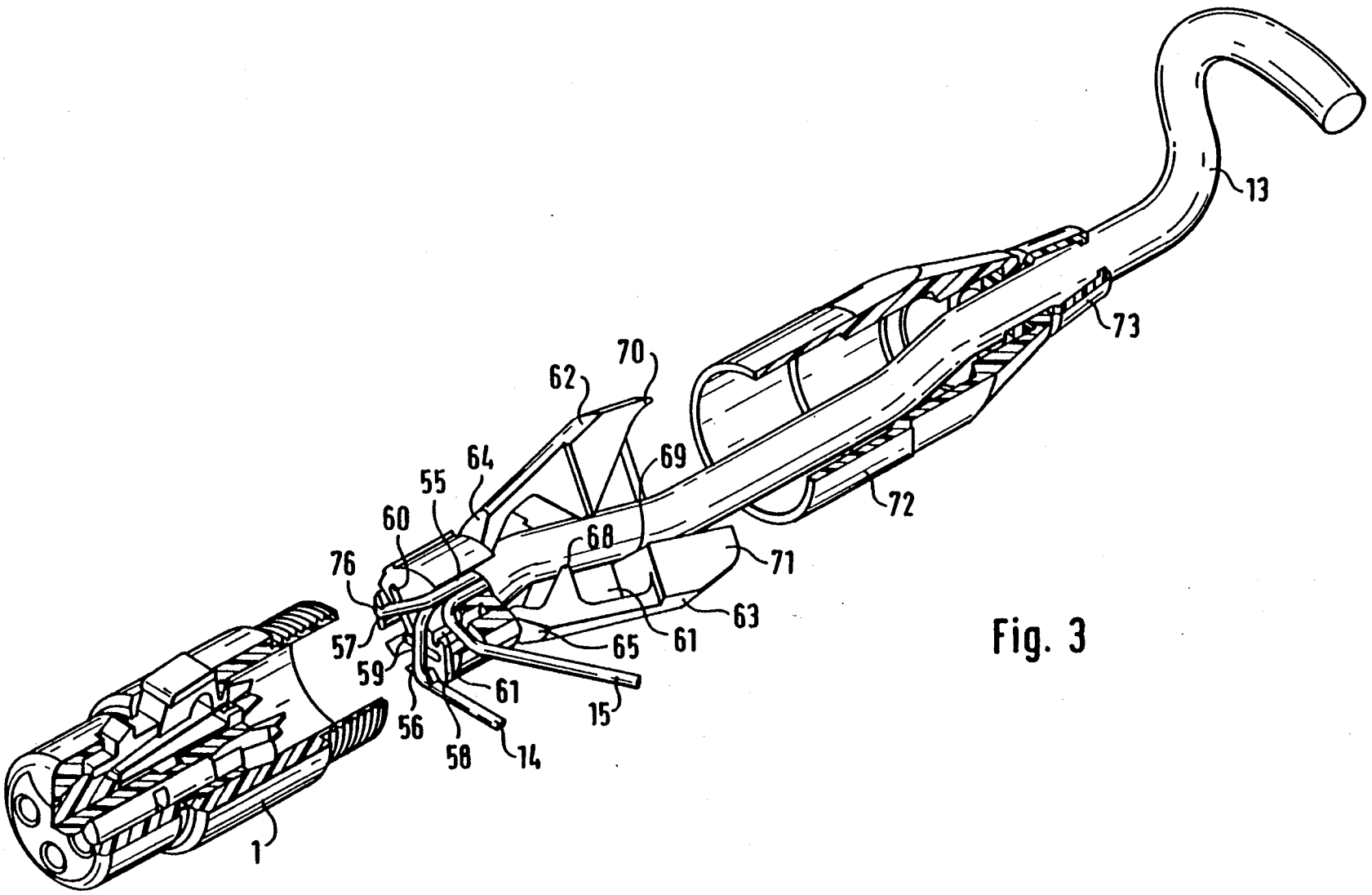
FIG. 3 is a cut-away perspective view of a second embodiment of a coupling connector element incorporating the invention.
Figure 4:
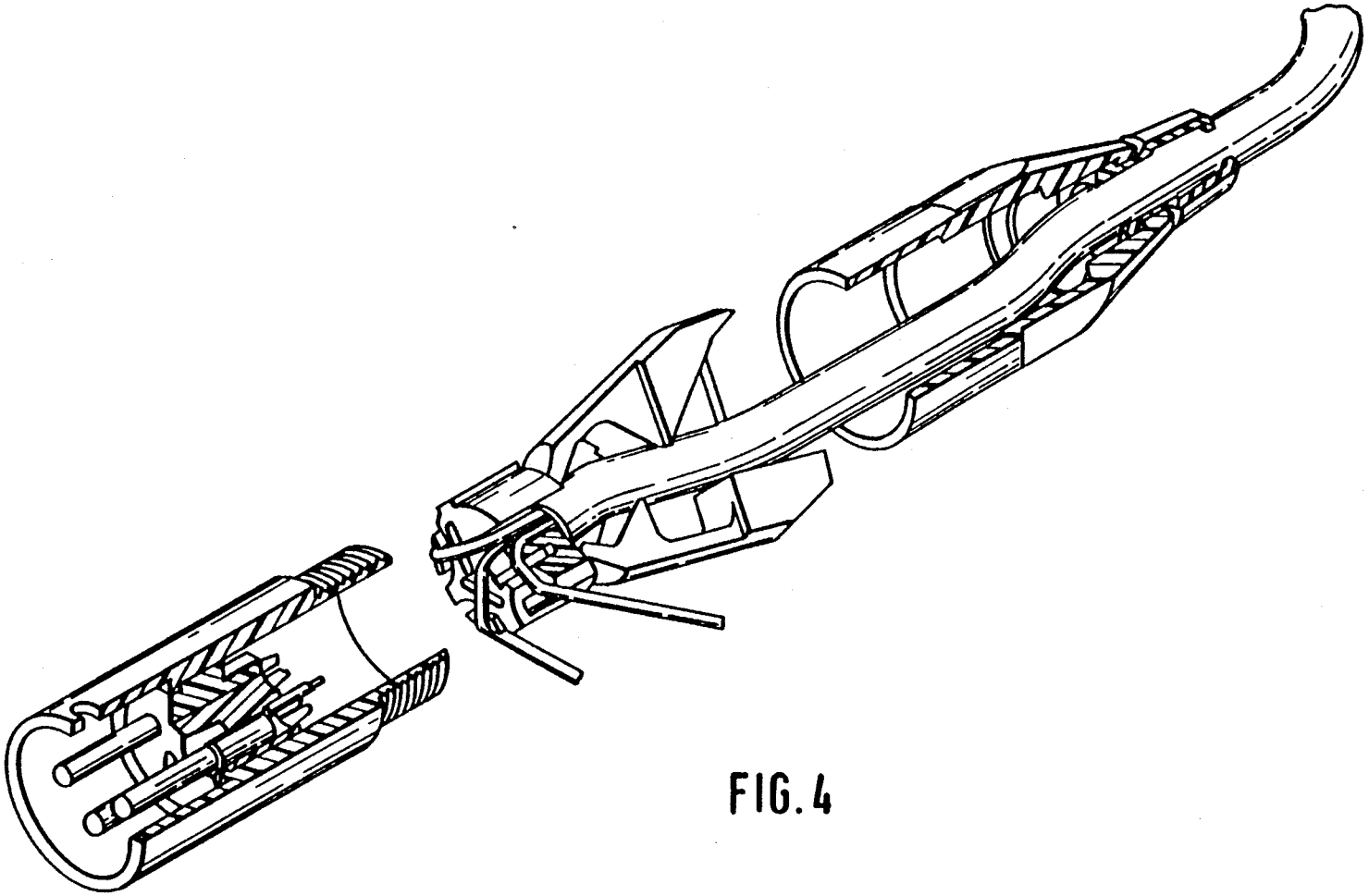
FIG. 4 is a cut-away perspective view of a coupling connector element for mating with the connector element shown in FIG. 3, incorporating the invention.
Figure 5:
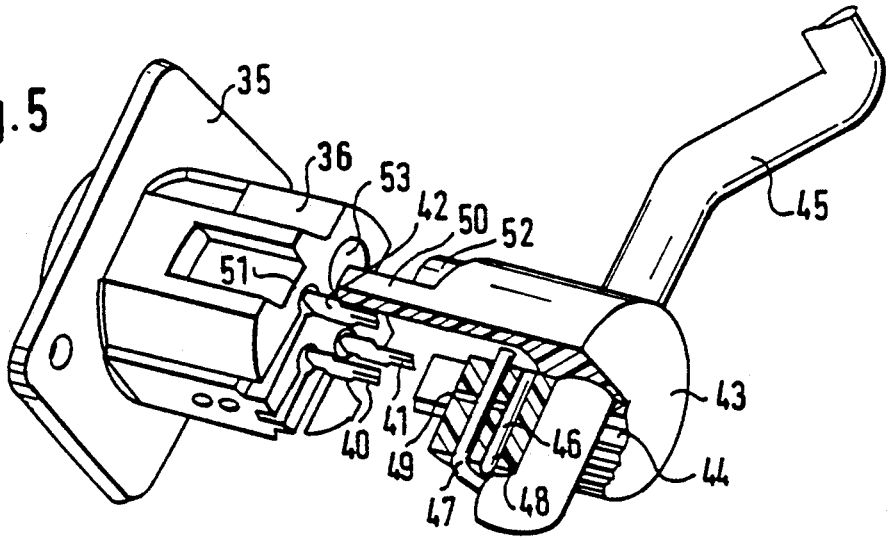
FIG. 5 shows a cut-away perspective view of a second embodiment of the present invention in the form of a socket connector.
Figure 6:
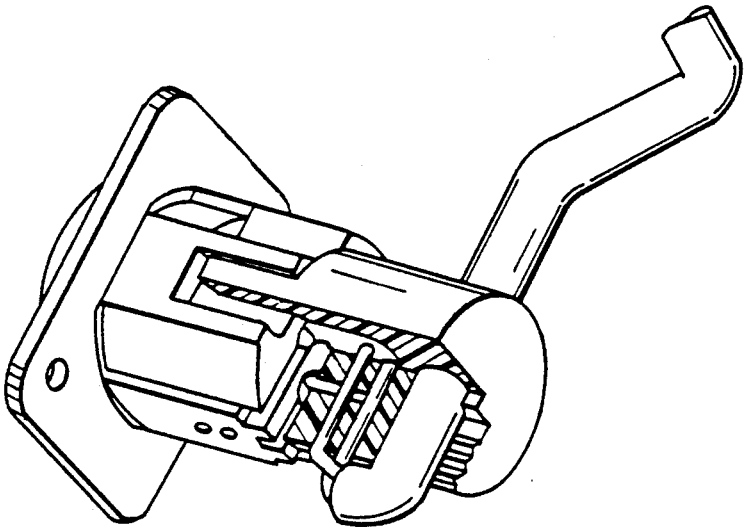
FIG. 6 is a perspective view of the socket connector of FIG. 3 in its terminated state.

Alternatively, the screw threaded portion 10 may be replaced by a known interference means (not shown) arranged to provide a push-on interference fit between the cup-shaped end portion and shell portion 3. Referring to FIGS. 3 and 4, the connector elements shown are similar to the connector elements shown in FIGS. 1 and 2, except that the central collet 11 of FIGS. 1 and 2 with its coaxial bore 12 and cable clamping means 14, is, in the embodiment of FIGS. 3 and 4, in the form of a cylindrical wire-support block 54 of thermo plastic material having grooves 53, 56 and 57 formed in its circumference. Wire-support block 54 further includes on its front surface 58 a plurality of axial slots 59, 60 and 61 for receiving insulation-displacement blades, as well as wire-guide channels laying transverse to respective axial slots. The insulations displacement blades are attached to axial contacts assembled on connector element 1 described above.

Extending from rear surface 4 of wire-support block 54 are two limbs 62 and 63 forming a pair of jaws, both limbs being hinged by a narrow flexible section 64, 65, although it will be understood that only one limb may be hinged. Limb 62 is provided with an inwardly extending transverse wedge 66 whose axis is substantially normal to the longitudinal axis of limb 62. Limb 63 is provided with a transverse channel section 67 opposite the thin edge of the wedge. The two sides of channel section 67 terminate in respective shoulders 68 and 69; shoulder 68 sloping rearwardly. Limbs 62 and 63 each terminate in a section 70, 71 extending inwardly toward each other at an obtuse angle.

A cylindrical outer shell 72 comprises a hollow plastics cylinder having a rear section in the shape of a conical frustum through which a cable enters. A resilient grommet 73 is fitted to the end of the rear section.

In use, and referring to FIGS. 3 and 4, the end of cord 13 is fed through grommet 73 and a predetermined length of sheath is removed from the end of cord 13 to expose lengths of insulated conductors 74, 75 and 76 which are laid in grooves 55, 56 and 57 and led to surface 58 where they are laid in the wire-guide slots and trimmed.

The jaws are then closed by axially moving outer shell 72 towards wire-support block 54 until the wire-support block is within the boundary of the outer shell 72. The axial movement of outer shell 72 causes the inner surface thereof to slidably abut sections 70 and 71 of the limbs, thereby closing the jaws causing the section of cord 13 traversing channel 67 to be bent and pinched between the thin edge of wedge 66 and shoulders 68 and 69 thereby providing a secure grip on cord 13 and conductors 74, 75 and 76 and relieving strain in both axial directions. Outer shell 72 is retained in position by friction, though other known means, such as a grub screw arrangement or screw thread, could be adapted.

Figure 7:
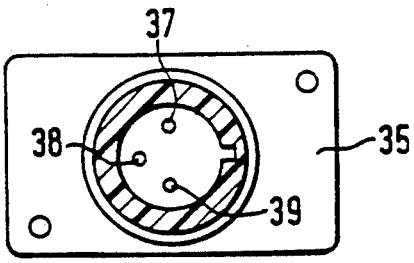
FIG. 7 is a front view of the connector shown in FIGS. 5 and 6 having an array of female contact elements.
Figure 8:
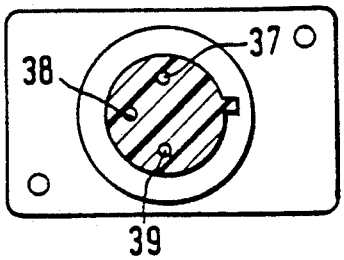
FIG. 8 is a front view of the connector shown in FIGS. 5 and 6 having an array of male contact elements.

The embodiment shown in FIGS. 5, 6, 7 and 8 is a chassis mounted connector assembly comprising a mounting plate 35 on whose rear surface is fixed a connector body 36, and on whose front face is a socket arrangement. Alternative socket arrangements are shown in FIGS. 7 and 8. The arrangement shown in FIG. 7 is for coupling with a plug having an array of male contact elements such as, for example, shown in FIG. 2; the arrangement shown in FIG. 8 is for coupling with a plug having an array of female contact elements, such as, for example shown in FIG. 1.

Within the boundary of connector body 36 is provided an array of contact elements (male or female) 37, 38 and 39 each fixedly supported within a cylindrical cavity (not shown). The rear portion of the contact elements protrude rearwardly through connector body 36. Attached to the rear portion of each contact element is a rearwardly extending insulation-penetrating slotted plate 40, 41 and 42.

The assembly further includes a terminating cap 43 comprising a clamping means 44 for clamping cable 45 whose insulated conductors, two of which 46 and 47 are shown; and wire-guide slots, only one, 48 being shown for locating insulated conductors 46 and 47 transverse scabbards, only one, 49 being shown.

The assembly further includes a radial locater means comprising a pair of fingers, one of which, 50, is shown extending from the terminating cap 43, for cooperating with a pair of depressions, one of which, 51 is shown, in the connector body 36. A press-fit means for correctly mating cap 43 with connector body 36 comprises a stub 52 and a receptacle 53.

In-use, a predetermined length of sheath is removed from an end of cable 45 to expose lengths of insulated conductors 46 and 47. The exposed end of cable is then fed through the clamping means 44 and the insulated conductors laid in respective wire-guide slots (48). Stub 52 and receptacle 53 are mated then terminating cap 43 and connector body 36 are axially pressed together causing the insulation-penetrating slotted plates 40, 41, 42 to enter respective scabbards thereby cutting into the transverse insulated conductors and establishing electrical connection between contact elements 37, 38, 39 and the conductors.

The cable to be connected to the connector element may include an uninsulated shielding sheath, and it is envisaged that this sheath will be connected to a contact element of the connector element by either contact with an insulation-penetrating slotted plate or by some other means. In the case where connection is by contact with an insulation-penetrating slotted plate, the associated wire-guide slot would be relatively larger than the wire-guide slots used for the insulated conductors.

The present invention has been described with regard to many particulars though it will be understood that equivalents may be readily substituted without departing from the scope of the invention.

The claims defining the invention are as follows:

1. An electrical connector element for a sheathed cable containing a locally insulated conductor, said connector element comprising:

a body member having a forwardly-extending contact element arranged therein and an opposite end that terminates in a rearwardly-extending insulation-penetrating means;

a cup-shaped end member having a side wall and a rear wall for defining an inner space and a co-axial hole for receiving said sheathed cable therethrough, and having means for releasably coupling said cup-shaped end member and said body member; and a mateable insulated-wire terminal means being arranged in the inner space of said cup-shaped end member, having a guide-slot means for receiving said locally insulated conductor, having a slot for receiving said rearwardly-extending insulation-penetrating means when said forwardly-extending contact element and said rearwardly-extending insulated wire terminal means are axially mated, and having a cable gripping means with two rearwardly extending longitudinal limbs for gripping said sheathed cable when said cup-shaped end member and said body member are coupled, at least one of said limbs being hingeable;

whereby when said cup-shaped end member and said body member are de-coupled said cable gripping means releases said sheathed cable.

2. An electrical connector element for a sheathed cable containing at least one insulated conductor, said connector element comprising:

an assembly of an outer shell member in which is fixedly located an insert member having fixedly supported within its boundary at least one forwardly-extending contact element whose opposite end terminates in a rearwardly-extending insulation-penetrating means;

a mateable insulated-wire terminal means including at least one slot arranged to receive said insulation penetrating means when said contact element housing and said insulated wire terminal means are axially mated, and an insulated wire guide means arranged transverse said slot;

a cup-shaped end member having a side wall joined by an end wall in which is provided a co-axial hole for receiving said sheathed cable therethrough and coupling means for releasably coupling said end member and said shell member;

said insulated wire terminal means including a cable gripping means having two longitudinal limbs extending rearwardly from said insulated-wire terminal means to form a pair of jaws, at least one limb being hinged by hinge means; and one of the two said limbs being provided intermediate its length with an inwardly extending protuberance opposite a space defined by two raised shoulders that extend inwardly from the other said limb, whereby when an end section of said cable is laid longitudinally between said limbs and a length of exposed at least one insulated conductor laid in said guide means, a part of said end section bridges said space such that upon closing said jaws, mating said contact element housing and said insulated-wire terminal means, and coupling said end member and said shell member, said part of said end section of said cable is pinched and gripped between said shoulders and said protuberances, and said insulation-penetrating means cuts the insulation of said at least one insulated wire in said guide means to provide electrical connection between said insulated wire and said contact element.

3. An electrical connector element as claimed in claim 2, wherein said hinge means comprises a flexible section in said limb.

4. An electrical connector element as claimed in claim 2, wherein a plurality of forwardly-extending contact elements are fixedly supported in an array within the boundary of said insert member for reception in an array of slots in said insulated-wire terminal means for electrically connecting said contact elements to respective insulated conductors of a sheathed cable incorporating a plurality of insulated conductors.

5. An electrical connector element as claimed in claim 2, wherein said contact elements are female contact elements.

6. An electrical connector element as claimed in claim 2, wherein said contact elements are male contact elements.

7. An electrical connector element as claimed in claim 2, wherein said insert member supports a latching means for releasably latching coupled connector elements.

8. An electrical connector element as claimed in claim 2, wherein said insulation-penetrating means comprises a slotted plate having two oppositely-spaced knife edges.

9. An electrical connector element as claimed in claim 2, wherein said protuberance is wedge-shaped whose edge lies in a plane substantially normal to the longitudinal axis of said one of the two said limbs.

10. An electrical connector element, as claimed in claim 9, wherein a section of each limb proximate their free end is bent inwardly at an obtuse angle to the remainder of the limb.

11. An electrical connector element as claimed in claim 9, wherein said hinge means comprises a flexible section in said limb.

12. An electrical connector element as claimed in claim 11, wherein a section of each limb proximate their free end is bent inwardly at an obtuse angle to the remainder of the limb.

13. An electrical connector element as claimed in claim 2, wherein said outer shell, said insert member, said insulated-wire terminal means and said cup-shaped end member are of circular cross-section.

14. An electrical connector element as claimed in claim 13, wherein said coupling means for releasably coupling said outer shell member and said cup-shaped member comprises push-on interference means provided on part of said side wall and co-operating interference means provided on said outer shell member.

15. An electrical connector element as claimed in claim 13, wherein said insert member supports a latching means for releasably latching coupled connector elements.

16. An electrical connector element as claimed in claim 13, wherein said insulation-penetrating means comprises a slotted plate having two oppositely-spaced knife edges.

17. An electrical connector element as claimed in claim 13, wherein said coupling means for releasably coupling said outer shell member and said cup-shaped end member comprise a screw thread provided on part of said side wall and co-operating screw thread provided on said outer shall member.

18. An electrical connector element as claimed in claim 17, wherein a plurality of forwardly extending contact elements are fixedly supported in an array within the boundary of said insert member for reception in an array of slots in said insulated-wire terminal means for electrically connecting said contact elements to respective insulated conductors of a sheathed cable incorporating a plurality of insulated conductors.

19. An electrical connector element as claimed in claim 18, wherein said contact elements are female contact elements.

20. An electrical connector element as claimed in claim 18, wherein said contact elements are male contact elements.

21. An electrical connector element as claimed in claim 18, wherein said contact elements comprise both male and female contact elements.

* * * * *